US010821454B2

(12) United States Patent
Delsard

(10) Patent No.: US 10,821,454 B2
(45) Date of Patent: Nov. 3, 2020

(54) SPRAY GUN WITH A HOLLOW NEEDLE AND SINGLE STAGE OR TWO STAGE NOZZLE AND METHOD FOR USE THEREOF

(71) Applicant: AXALTA COATING SYSTEMS IP CO., LLC, Wilmington, DE (US)

(72) Inventor: Bert Delsard, Westerio (BE)

(73) Assignee: AXALTA COATING SYSTEMS IP CO., LLC, Wilmington, DE (US)

( * ) Notice: Subject to any disclaimer, the term of this patent is extended or adjusted under 35 U.S.C. 154(b) by 172 days.

(21) Appl. No.: 15/556,603

(22) PCT Filed: Mar. 11, 2015

(86) PCT No.: PCT/US2015/019931
§ 371 (c)(1),
(2) Date: Sep. 7, 2017

(87) PCT Pub. No.: WO2016/144353
PCT Pub. Date: Sep. 15, 2016

(65) Prior Publication Data

US 2018/0050357 A1 Feb. 22, 2018

(51) Int. Cl.
*B05B 7/08* (2006.01)
*B05B 7/06* (2006.01)
(Continued)

(52) U.S. Cl.
CPC ..... *B05B 7/0815* (2013.01); *B05B 7/065* (2013.01); *B05B 7/1209* (2013.01);
(Continued)

(58) Field of Classification Search
CPC ... B05B 7/0815; B05B 7/1209; B05B 7/1218; B05B 7/025
(Continued)

(56) References Cited

U.S. PATENT DOCUMENTS 1,689,848 A * 10/1928 Anderson ..... B05B 7/1209 239/300
2,602,004 A * 7/1952 Faktor ..... B05B 7/0815 239/301
(Continued)

FOREIGN PATENT DOCUMENTS

CN 102917803 A 2/2013
CN 103842094 A 6/2014
(Continued)

OTHER PUBLICATIONS

China National Intellectual Property Administration, First Office Action for Chinese Patent Application No. 201580079200.3, dated Dec. 25, 2019.
(Continued)

*Primary Examiner* — Viet Le
(74) *Attorney, Agent, or Firm* — Lorenz & Kopf, LLP

(57) ABSTRACT

A paint spray gun comprises a spray gun body; an air cap; and a hollow needle capable of assuming at least an open position enabling the passage of paint therethrough and a closed position; at least one air distribution channel for atomizing air; and at least one air distribution channel for fan air. A fluid spray single two stage nozzle includes first and second internal surfaces at first and second predetermined angles, respectively, with respect to a rotational axis of symmetry of the nozzle, wherein the first angled surface is proximate a forward opening of the nozzle, the second angled surface is aft of the first angled surface, the first angle is in a range of substantially 0.05 to thirty degrees, and the second angle ranges from substantially 0.1 to sixty degrees greater than that of the first angle.

4 Claims, 13 Drawing Sheets

(51) Int. Cl.
*B05B 7/24* (2006.01)
*B05B 7/12* (2006.01)
*B05B 7/02* (2006.01)

(52) U.S. Cl.
CPC ..... *B05B 7/1218* (2013.01); *B05B 7/2435* (2013.01); *B05B 7/025* (2013.01); *B05B 7/068* (2013.01)

(58) Field of Classification Search
USPC ..... 239/290
See application file for complete search history.

(56) References Cited

U.S. PATENT DOCUMENTS 2,780,496 A * 2/1957 Asbeck ..... B05B 7/1209 239/290
2,958,471 A * 11/1960 Zippel ..... B05B 7/0815 239/414
3,066,874 A * 12/1962 Becker ..... B05B 7/1263 239/415
4,529,126 A * 7/1985 Ives ..... F16K 1/38 239/112
5,685,482 A 11/1997 Sickles
5,799,875 A * 9/1998 Weinstein ..... B05B 7/0815 239/296
9,782,784 B2 * 10/2017 Schmon ..... B05B 7/064
2005/0284963 A1 * 12/2005 Reedy ..... B05B 7/2416 239/526
2012/0160935 A1 * 6/2012 Krayer ..... B05B 7/025 239/291
2013/0056556 A1 * 3/2013 Schmon ..... B05B 7/064 239/296
2013/0320110 A1 * 12/2013 Brose ..... B05B 7/2489 239/302
2014/0353395 A1 * 12/2014 Charpie ..... B05B 1/32 239/1

FOREIGN PATENT DOCUMENTS

CN 103930216 A 7/2014
DE 4230535 A1 3/1994

OTHER PUBLICATIONS

International Searching Authority, International Search Report and Written Opinion for International Patent Application No. PCT/US2015/019931, dated Nov. 6, 2015.

* cited by examiner

SPRAY GUN WITH A HOLLOW NEEDLE AND SINGLE STAGE OR TWO STAGE NOZZLE AND METHOD FOR USE THEREOF

CROSS REFERENCE TO RELATED APPLICATION

This application is a U.S. National-stage entry under 35 U.S.C. § 371 based on International Application No. PCT/US2015/019931, filed on Mar. 11, 2015 which was published under PCT Article 21(2) and is incorporated in its entirety herein.

TECHNICAL FIELD

This application pertains to spray guns and the use thereof and, more particularly, to a method and apparatus for producing a gravity feed by means of a hollow needle and a single stage or two stage nozzle.

BACKGROUND

Liquid paints have become more and more important in recent years in various fields of applications including, vehicle coating and vehicle refinish coating. Vehicle refinish coating compositions are typically applied onto a substrate, i.e. an automobile vehicle body or body parts, using a manual spray gun and then cured to form the final coating layer A known vehicle refinish spray gun includes an attached or remotely coupled pressure cup or pump system that delivers a liquid paint stream into the nozzle duct of the spray gun. Gravity feeding of the liquid paint was not possible because the spray gun utilized angular atomization which, when triggering, builds up an area of increased pressure (ΔP+) in front of the fluid tip and in the nozzle duct, as a result, will not permit a gravity feed. In addition, pressure feed or pump feed liquid paint dosing systems are very expensive and not user-friendly when using small amounts of liquid paints (e.g. 0.3 to 1 liters). Cleaning is also an issue, and expensive residual paint in the paint tubes from the feeding systems represent a major cost for the end user.

Therefore, it would be desirable to provide a user-friendly, gravity feed, liquid paint-cup-compatible spray paint system incorporating a single or two stage nozzle for use in the field of manual liquid paint applications. It would further be desirable that the spray paint system include a hollow needle coupled to an atomizing air duct for transporting a part of the atomizing air to a certain position in the nozzle duct that changes the area of increased pressure (ΔP+) back to an area of lower pressure (ΔP−).

BRIEF SUMMARY

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

In accordance with an embodiment, there is provided spray gun comprising a spray gun body, an air cap, a fluid spray nozzle having a fluid tip, a hollow needle, at least one air distribution channel for atomizing air, and at least one air distribution channel for fan air, wherein the fluid spray nozzle and the air cap are configured to direct an atomization air flow at an angle of 10 to 75 degrees relative to a pre-atomized coating composition jet, into the pre-atomized coating composition jet.

In accordance with a further embodiment, there is provided a fluid spray nozzle/air cap assembly for directing an atomization air flow at an angle of 15 to 60 degrees relative to a pre-atomized coating composition jet into a pre-atomized coating composition jet, comprising a duct, an atomizing air channel, and a hollow needle coupled via the duct to the atomizing air channel for transporting 50-150 li/min of the atomizing air into the spray nozzle, the fluid spray nozzle and the air cap providing an atomizing air pressure to fan air pressure ratio of substantially 0.5 to 1.0.

In accordance with a still further embodiment, there is provided a method for applying a layer of a water-based coating composition onto a substrate with a spray gun. The method comprises directing an atomization air flow at an angle of substantially 15 to 60 degrees through an atomizing air channel, relative to a pre-atomized coating composition jet, into the pre-atomized coating composition jet, transporting, with a hollow needle that is coupled via a duct to the atomizing air channel, substantially 50-150 li/min of the atomizing air into a fluid spray nozzle; providing an atomizing air pressure to fan air pressure ratio of substantially 0.5 to 1.0 via the fluid spray nozzle and the air cap, and applying at least one layer of the water-based coating composition onto a substrate, wherein the water-based coating composition is applied with an atomizing air pressure to fan air pressure ratio of substantially 0.1 to 10.

The embodiments described herein are directed to a spray gun, specifically a manual spray gun, particularly suited for applying a layer of a water-based coating composition onto a substrate, the spray gun comprising a spray gun body, an air cap, a fluid spray nozzle duct having a fluid tip that includes a hollow needle, at least one air distribution channel for the atomizing air, and at least one air distribution channel for the fan air, and a hollow needle that is connected to an atomization air duct, transporting a certain atomization air volume to the nozzle duct at a well-defined position in the nozzle duct when fully triggering the spray gun.

This atomization air volume, substantially 50 to 150 li/min, preferably substantially 80-120 li/min. will create a pressure drop in the nozzle duct and in front of the nozzle tip, assuring a vacuum in the gravity cup. The vacuum is measured in a range of substantially 20-500 PA (Pascale) depending on the diameter of the hollow needle/nozzle tip, the air volumes through the needle, and the atomizing air pressure at fluid tip originated by the angular atomization.

Spray guns in accordance with the prior art vacuum measured substantially 40-400 PA using specified atomizing air (AA) pressure between substantially 2-3 bar pressure at the heel of the gun. Guns tested included the Sata RP4000 jet, Iwata WS400, Devilbiss GTI Pro, Devilbiss GTI PRO lite, and the Sata 3000 HVLP Furthermore, other desirable features and characteristics of the system and method will become apparent from the following detailed description and the appended claims, taken in conjunction with the accompanying drawings and the preceding background.

BRIEF DESCRIPTION OF THE DRAWINGS

Embodiments of the subject matter will hereinafter be described in conjunction with the following figures, wherein like numerals denote like elements, and:

FIG. 3A illustrates the embodiment of FIG. 2A in operation and having a paint jet (i.e., a coating composition jet, atomizing air flow, and a fan air flow), and FIG. 3B illustrates the embodiment of FIG. 2B in operation and having a paint jet (i.e., a coating composition jet, atomizing airflow, and a fan airflow).

DETAILED DESCRIPTION

Figure 1A:
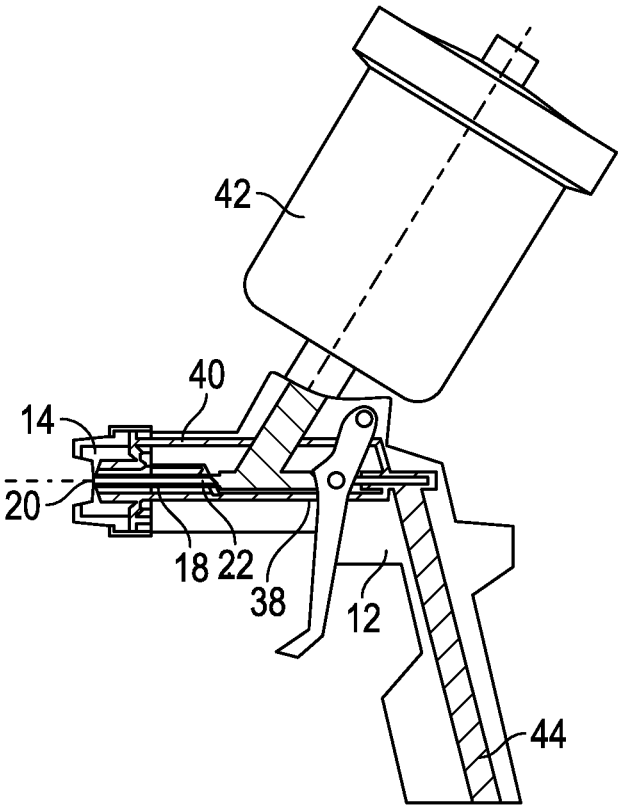
FIGS. 1A and 1B are side views of representative examples of a spray gun having a coating cup affixed at the upper side of the spray gun, a representative example of the spray gun having a coating cup affixed at the lower side of the spray gun. These figures also show a schematic presentation of a typical manual spray gun with spray gun body, air cap, fluid spray nozzle, fluid tip, hollow needle, air distribution channels, a paint cup, an and inlet air channel.

The features and advantages of the present invention will be more readily understood, by those of ordinary skill in the art, from reading the following detailed description. It is to be appreciated that certain features of the invention, which are, for clarity, described above and below in the context of separate embodiments, may also be provided in combination in a single embodiment. Conversely, various features of the invention that are, for brevity, described in the context of a single embodiment, may also be provided separately or in any sub-combination. In addition, references in the singular may also include the plural (for example, "a" and "an" may refer to one, or one or more) unless the context specifically states otherwise.

Water-based coating compositions are coating compositions, wherein water is used as a solvent or thinner when preparing and/or applying the coating composition. Usually, aqueous coating compositions contain about 20% to 80% by weight of water, based on the total amount of the coating composition and optionally, up to about 15% by weight, preferably, below about 10% by weight of organic solvents, based on the total amount of the coating composition.

The spray gun of the embodiment described herein or which can be suitable in the methods described herein is particularly suited as a manual (or hand-held) spray gun. A manual spray gun is a spray gun which is used manually by a human, i.e. a coating composition is manually sprayed with the spray gun by a human. A manual spray gun is not a spraying device used in or as a spraying robot or a spraying machine or robot or handled by a spraying machine or spraying robot. Manual spray guns are typically used for applying coating compositions in vehicle refinishing, particularly in vehicle repair coating in refinish body shops. However, the spray gun of the present invention can also be used in a spraying robot or a spraying machine or can be handled by a spraying robot or a spraying machine.

Atomizing air (AA) is defined as the airflow or air volume that breaks the liquid paint jet, which will be used hereinafter synonymously with coating composition jet, coming from the fluid tip of the fluid spray nozzle, into small droplets. Fan air (FA) is defined as the airflow or air volume that pushes the atomized paint jet into a desired paint jet form, such as a spherical form, and preferably an elliptical cone.

The spray gun in accordance with an embodiment and which can be used in the method of the embodiment is operable by using high air volume and high air pressure, measured at the air cap outlet.

Air volumes of, for example, substantially 50 liters/minute (l/min) to 600 l/min, preferably substantially 100l/min to 600l/min, and more preferably substantially 200l/min to 500 l/min, measured at the air cap outlet, can be used. Atomizing air volume and fan air volume can be separately in the range of substantially 50l/min to 600l/min, and preferably substantially 100l/min to 500l/min. A respective input air volume is selected accordingly.

The atomizing air pressure can, for example, be in the range of substantially 0.5 bar to 5.0 bar, preferably substantially 1.0 bar to 5.0 bar, still more preferably substantially 2.0 to 4.0 bar, measured at the air cap outlet. The fan air pressure can be, for example, in the range of substantially 0.5 bar to 5.0 bar, preferably substantially 1.0 bar to 5.0 bar, and still more preferably substantially 2.0 bar to 4.0 bar, measured at the air cap outlet. Accordingly, an input air pressure of, for example, substantially 2.0 to 12.0 bar is needed. The respective input air pressure can be generates by a turbine compressor.

The spray stream or coating composition jet may be produced by using a gravity cup. Even if compressed air is preferably used and referred to herein throughout, other pressurized carriers, such as compressed gas other than air or a compressed gas mixture, can also be used.

The spray gun and the method of the embodiments described herein has a fluid spray nozzle and an air cap which are both configured to direct an atomization air flow at an angle of substantially 10-75 degrees, preferably substantially 15-60 degrees, and more preferably substantially 30-45 degrees (relative to the coating composition jet) into the coating composition jet. Stated differently, the fluid spray nozzle and the air cap are both configured such that the angle formed by the central axis of the coating composition jet and the central axis of the atomization air flow is substantially 10-75 degrees, preferably substantially 15-60 degrees, and still more preferably substantially 30-45 degrees. The central axis of the coating composition jet is at a ninety degree angle relative to the fluid tip surface or laminar to the fluid tip opening.

Accordingly, the fluid spray nozzle is configured such that it has the form of a substantially 10-75 degree, preferably substantially a 15-60 degree, and still more preferably substantially a 30-45 degree cone terminating to a substantially 10-75 degree, preferably substantially 15-60 degree, and still more preferably a substantially 30-45 degree angular fluid tip. Accordingly the air cap is formed with a central substantially 10-75 degree, preferably substantially 15-60 degree, and still more preferably substantially 30-45 degree angular air aperture (opening). The profile of the fluid spray nozzle is a substantially 10-75 degree, preferably substantially 15-60 degree, and still more preferably 30-45 degree frustum, terminating at the substantially 10-75 degree, preferably substantially 15-60 degree, and more preferably substantially 30-45 degree angular fluid tip, through which the water-based coating composition is discharged (see FIGS. 2 to 4).

During operation of the spray gun a first flow of atomizing air is transported through the hollow needle and causes a pre-atomization of the coating composition jet in the nozzle. A second flow of atomization air emerges through the gap between the fluid spray nozzle and the air cap. This atomizing airflow hits the pre-atomized paint jet, i.e., the coating composition jet, coming out of the fluid tip of the nozzle (which has a conical form—see FIG. 3) and breaks the pre-atomized paint jet further, i.e., the coating composition jet, into very small atomized droplets. If desired the pre-atomized paint jet can be conical. In other words it changes the coating composition jet into an atomized fluid stream of fine droplets. The final two-stage atomized paint jet can be corrected to a very stable and very homogeneous spray cone by applying the correct fan air flow. During operation of the spray gun, 10 to 50%, more preferred 25-35% of the total atomization air volume is transported through the hollow needle, assuring gravity and pre atomization of the coating composition jet.

The other substantially 50-90%, more preferred substantially 65-75% of the total atomization air volume is directed at an angle of substantially 10-70 degrees, preferably substantially 15-60 degrees, and more preferably substantially of 30-45 degrees (relative to the coating composition jet) into the pre-atomized paint jet. The fluid spray nozzle and air cap can contain additional bores to direct the remaining part of the atomization air volume.

Generally the fluid spray nozzle and the air cap of a spray gun form a unified system, i.e. a specific fluid spray nozzle requires a specific air cap configured to match; for example, the opening of the air cap has to be adjusted according to the diameter of the fluid tip of the nozzle.

The fluid spray nozzle and the air cap of the spray gun, together with the air distribution channels, are configured to provide an atomizing air pressure to fan air pressure ratio (AA/FA ratio) of substantially 0.1 to 10, preferably substantially 0.5 to 1.0, and more preferably substantially of 0.6 to 0.9, measured at the air cap outlet. The AA/FA ratio can be, for example, 2 bar:3 bar to 2.5 bar:3 bar. The design of the fluid spray nozzle and the air cap can be configured in different ways in order to ensure the desired AA/FA ratio. The fluid spray nozzle and the air cap contain at least one air channel for the atomizing air and at least one air channel for the fan air. According to one embodiment the diameter of the air channels can be selected such that the desired AA/FA ratio can be adjusted in the operation status of the spray gun. According to a further embodiment means can be included for regulating the air flow volumes (and accordingly the air pressure) in the separate air channels at given air channel diameters. Air flow volumes can be regulated, for example, by air valves. Also, according to yet a further embodiment, both of the above measures, the air channel diameter and the regulation of the air flow volume by respective means, can be used. The selection of appropriate air channel diameters and air flow volume regulating means can be made by a person skilled in the art.

In addition, the fluid spray nozzle or the air cap or both may contain bores to direct the atomization or the fan air flow. The number, diameter, and position of the respective bores may be selected by a person skilled in the art so as to achieve the desired air volume and air pressure.

The manual spray gun in accordance with the present embodiment comprises the spray gun body, an air cap at the front of the spray gun body, a fluid spray nozzle and a hollow needle. The air cap is formed with horns in order to supply the fan air. The spray gun comprises at least two air distribution channels, one for the atomizing air and another for the fan air. According to one embodiment, the compressed air enters the spray gun body via an inlet air channel, e.g. a central inlet air channel. The inlet air channel is separated into the at least one atomizing air channel and at least one fan air channel.

According to a further embodiment, the incoming compressed air may directly be divided at the air inlet into at least one atomization air stream and at least one fan air stream. The air distribution channels are configured accordingly. Preferably, the spray gun comprises a compressed air distribution system; i.e. it comprises at least one compressed air inlet channel and two separate air distribution channels—one for the atomization air and one for the fan air. The spray gun body preferably comprises means dividing the incoming air into a first air flow that provides atomizing air around the fluid spray nozzle and in the hollow needle and into a second air flow that provides the fan air to the horns of the air cap. One or more air channels for the atomizing and the fan air may be present.

Separation and regulation of the compressed input air into atomizing air and fan air can be realized by means of air valves independently regulating the atomizing and fan air volume (and accordingly the air pressure).

According to a further embodiment, the spray gun can additionally have pressure valves and digital read-out on the separate air channels, regulating separately the atomizing air flow and fan air flow to set the desired ratio AA/FA, measured at the air cap outlet. The fluid spray nozzle may have a fluid tip opening diameter of substantially 0.1 to 5 mm or substantially 0.7 to 2.5 mm.

The spray gun body may have additional multiple parts and controls, as typically used in manual spray guns; for example, a flow regulator for regulating the flow of the coating composition, and other mechanisms necessary for proper operation of a manual spray gun known to those skilled in the art. Typically, multiple channels, connectors, connection paths, and mechanical controls can be assembled within the spray gun body.

The previously described design of the fluid spray nozzle, the air cap, and hollow needle, in combination with at least one atomizing air channel and the at least one fan air channel, permit adjustment of the desired AA/FA pressure ratio and direct the atomization air flow at the desired angle into the pre-atomized coating composition jet.

The present embodiments descried herein also relates to a fluid spray nozzle/air cap/hollow needle assembly, wherein A) the fluid spray nozzle and the air cap are configured to direct an atomization air flow at an angle of substantially 10 to 75 degrees, preferably substantially 15 to 60 degrees, and more preferably substantially 30 to 45 degrees, relative to the pre-atomized coating composition jet, into the pre atomized coating composition jet, and B) the fluid spray nozzle/the air cap/the hollow needle are configured to provide an atomizing air pressure to fan air pressure ratio of substantially 0.1 to 10, and preferably substantially 0.5 to 1.0.

The details, embodiments, and preferred embodiments of the fluid spray nozzle, the air cap, and the hollow needle of the fluid spray nozzle/air cap/hollow needle assembly are the same as described above for the fluid spray nozzle, the air cap, and hollow needle as part of the spray gun. The fluid spray nozzle/air cap assembly can be used in any type of spray gun, for example in a manual spray gun, and also in a spraying robot, a spraying machine, or any other spraying device.

In an embodiment, a layer of a water-based coating composition is applied onto the substrate by the above described spray gun, with an atomizing air pressure to fan air pressure ratio of substantially 0.1 to 10, preferably substantially 0.5 to 1.0, and more preferably substantially 0.6 to 0.9.

The spray gun and the fluid spray nozzle/air cap/hollow needle assembly and the method of use thereof can specifically be used for applying water-based coating compositions. Typical water-based coating compositions comprise binders, optionally cross-linkers, and a liquid carrier. The liquid carrier is water and may comprise in addition one or more organic solvents. Binders are, for example, compounds with functional groups with active hydrogen. These compounds can be oligomeric or polymeric binders. In order to ensure sufficient water dilutability of the binders, they are modified to render them hydrophilic, e.g., they can be anionically modified by incorporation of acid groups. The water-based coating compositions may contain cross-linkers, for example, polyisocyanates with free isocyanate groups. Examples of polyisocyanates are any number of organic di- or higher functional isocyanates with aliphatically, cycloaliphatically, araliphatically and/or aromatically bound free isocyanate groups. The polyisocyanate cross-linkers are those commonly used and commercially available in the paint industry and are described in detail in the literature.

The water-based coating compositions may contain pigments, solid pigments as well as effect pigments, fillers, and/or usual coating additives. Examples of usual coating additives are light stabilizers, for example, based on benztriazoles and HALS (hindered amine light stabilizer) compounds, flow control agents based on (meth)acrylic homopolymers or silicon oils, rheology-influencing agents, such as, highly disperse silicic acid or polymeric urea compounds, thickeners, such as, cross-linked polycarboxylic acid or polyurethanes, anti-foaming agents, and wetting agents.

The water-based coating compositions to be applied with the spray gun and the fluid spray nozzle/air cap assembly can be any kind of paints such as waterborne clear coats, water-borne top coats, water-borne base coats, and water-borne primers.

The water-based coating composition may be applied onto a pre-coated substrate. Suitable substrates are metal and plastics substrates, in particular, the substrates known in the automotive industry, such as for example iron, zinc, aluminium, magnesium, stainless steel or the alloys thereof, together with polyurethanes, polycarbonates or polyolefines. In the case of a multilayer coating with a water-based base coat composition and water-based clear coat composition, the clear coat layer may be applied onto the base coat layer either after drying or curing or wet-on-wet, optionally after briefly flashing off. They water-based coating compositions may comprise a one-component or two-component coating. After the layer of the water-based coating composition has been applied, it may initially be flashed off to remove water and optionally present organic solvent. Curing may then proceed at ambient temperature or thermal curing may proceed at temperatures of, for example, substantially 40 to 140° C., and preferably at substantially 40 to 60° C.

The spray gun and the fluid spray nozzle/air cap assembly for applying water-based coating compositions and the method can preferably be used in vehicle repair coating, but also in an original vehicle production line painting as well as for coating large vehicles and transportation vehicles, such as trucks, busses, and railroad cars. However, the spray gun can also be used for applying water-based coating compositions onto other substrates in other fields of application; for example, onto wood, plastic, leather, paper and other metal substrates as well as onto woven and nonwoven fabrics.

Figure 1B:
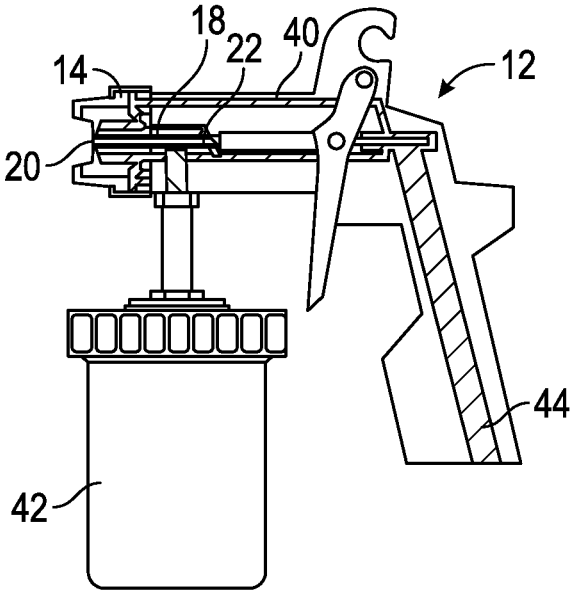

In accordance with an embodiment, the spray gun comprises a spray gun body 12, (e.g. FIGS. 1A and 1B) a fluid spray nozzle/air cap/hollow needle assembly comprising an air cap assembly 14, a fluid spray nozzle 18 having a fluid tip orifice 20, a hollow needle 22, at least one atomization air distribution channel 30 (e.g. FIG. 3A) for distributing an atomizing air 60, and at least one fan air distribution channel 26 for distributing a fan air 58. The fluid spray nozzle 18 and air cap assembly 14 are configured to direct atomizing air 60 to form an atomization air flow 24 evenly in a rotational symmetry around a rotational axis Z-Z' of the fluid spray nozzle and all around the fluid tip orifice 20 at an atomization air flow angle 84 in a range of from substantially 10 to 75 degrees, relative to the rotational axis Z-Z. This atomization air flow 24 at an atomization air flow angle 84 (e.g. FIG. 4C) in a range from substantially 10 to 75 degrees, relative to the rotational axis Z-Z' generates an area of increased pressure $\Delta P+$ in front of the fluid tip and in the nozzle duct resulting in the absence of gravity feed and the presence of air bubbles in the gravity cup. The spray gun further comprises a hollow needle that transports atomizing air in a range of substantially 50-150 li/min into the fluid nozzle an generating an area of low pressure in front of the fluid tip and in the nozzle duct, pressure ΔP−, resulting in gravity feed. At the same time the hollow needle atomizing airflow generates a pre-atomization in the nozzle. The atomizing air 60 and the fan air 58 provide an atomizing air pressure to a fan air pressure ratio of substantially 0.1 to 10.

The atomizing air pressure and air volume stream as well as the fan air pressure and air volume stream can be regulated by the nozzle and air cap design. The atomizing air pressure and the fan air pressure can be regulated by configuring relative sizes of the atomization air distribution channel 30 and the fan air distribution channel 26 (e.g., FIG. 2A), using one or more regulators to regulate air supplied to the atomization air distribution channel 30 and the fan air distribution channel 26, providing separate pressurized air of the desired air pressures to the atomization air distribution channel 30 and the fan air distribution channel 26, or a combination thereof. The spray gun can be configured to provide from substantially 0.1 to 600 liter/min, and preferably from 0.1 to 500 liter/min air volume stream to the air cap opening 66 (e.g. FIGS. 2A and 4A) and in a range of from substantially 0 to 500 liter/min air volume stream up to the fan air outlets 80 (e.g. FIGS. 3A and 3B). Referring again to FIGS. 1A and 1B, the spray gun can further comprise one or more air distribution channels 38 and 40, paint cup 42, and inlet air channel 44. The paint cup 42 can be attached to the upper side of the spray gun body or the underside of the spray gun body.

The fluid spray nozzle and the air cap can be assembled to form the fluid spray nozzle and air cap assembly via conventional mechanisms, such as matching screw tracks, clippers, or other mechanisms to assemble the parts. The fluid spray nozzle may comprise a spray needle 22 that slides along the rotational axis Z-Z' of the fluid spray nozzle in the directions shown by the arrow 32 between a closed position and an open position to close or open the fluid tip orifice 20 inside the fluid spray nozzle (FIGS. 2A, 3, and 6), respectively. By controlling the position of the spray needle between the closed and the open positions, the amount of coating spraying through the fluid tip orifice can also be controlled. Once properly assembled, the fluid spray nozzle's fluid tip orifice can be positioned flush with the air cap spray opening 66. The external plane 68 of the air cap spray opening 66 and the outmost tip plane of the fluid tip orifice 34 are projected planes perpendicular to the rotational axis Z-Z'. The outmost tip plane of the fluid tip orifice 34 can be protruding or recessed relative to the external plane 68 of the air cap spray opening 66 in a range of from substantially 0 to 2 mm in one example, substantially 0 to 1 mm in another example, and substantially 0 to 0.5 mm in yet another example. Representative examples of cross-sectional views of the fluid spray nozzle and air cap assemblies in spray operation configurations are shown in FIGS. 3A and 3B.

The air cap opening inner-surface 62 is a surface inside the air cap towards the fluid spray nozzle immediately around the air cap opening 66 and can be the entire (FIGS. 2A, 3A, and 4A-4D) or a portion (FIGS. 2B, 3B, and 4E) of the surface inside the air cap.

Figure 4A:
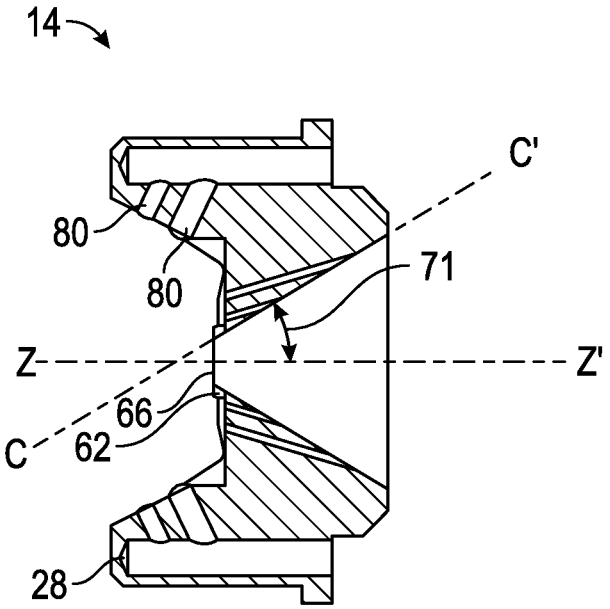
FIGS. 4A-4E illustrate representative examples of (A) a cross-sectional view of the air cap, (B) a frontal perspective view of the air cap, (C) a cross-sectional view of the air cap and fluid spray nozzle assembly, and examples of suitable configurations (D) and (E) of the air cap. One embodiment of an air cap with horns, fan air channel, and an atomizing air channel is shown. In a particular embodiment, an angle paint jet, i.e., coating composition jet/atomizing air flow of substantially 45 degrees is used.
Figure 4B:
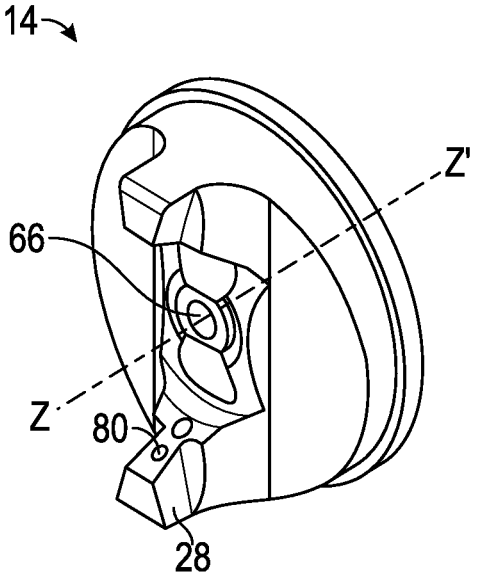
Figure 4C:
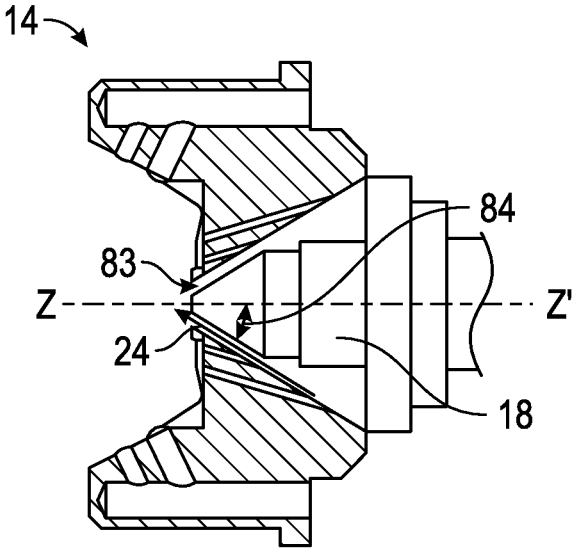
Figure 4D:
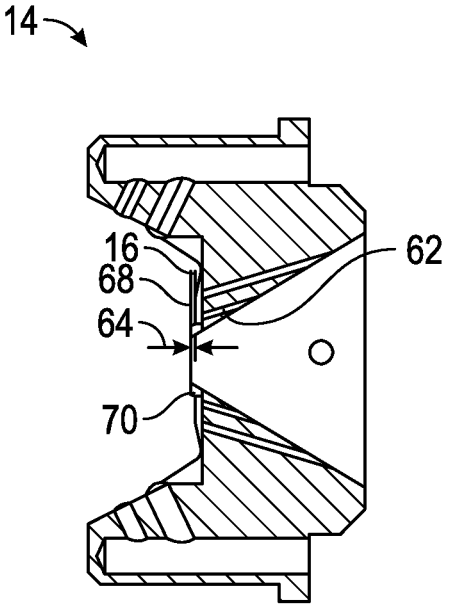
Figure 4E:
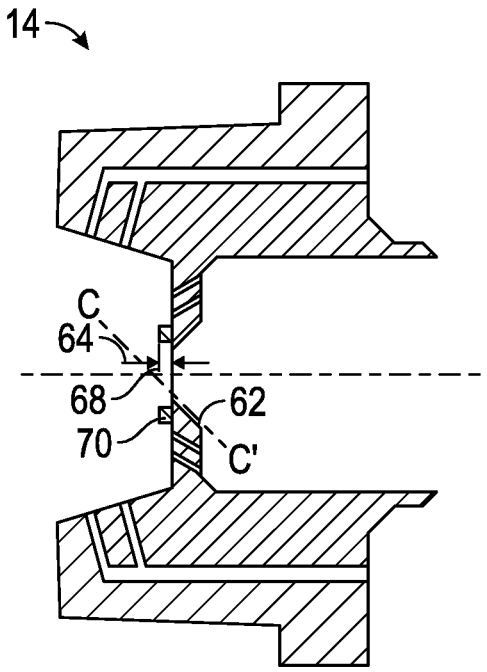
Figure 5A:
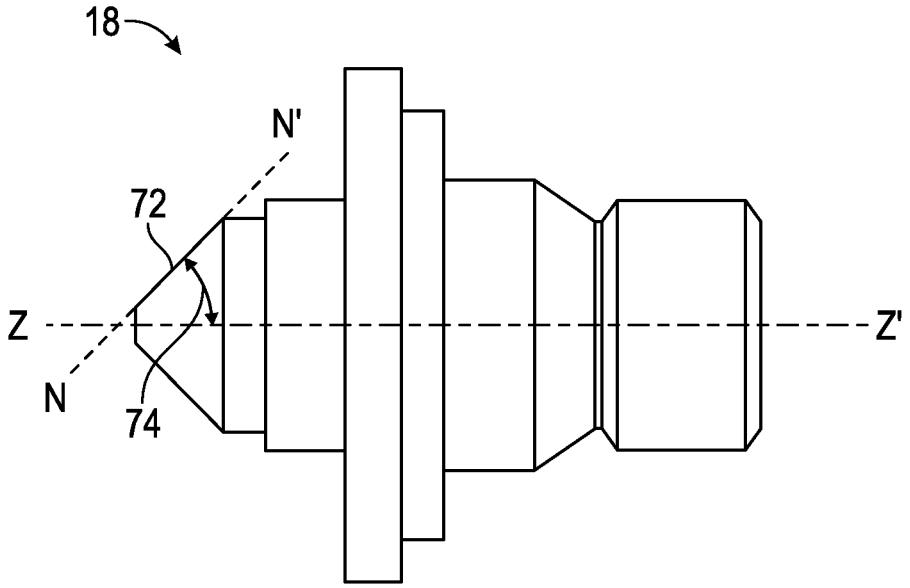
FIGS. 5A-5C illustrate representative examples of a side view, a cross-sectional view, and a perspective view of the of the fluid spray nozzle. A representative example of a substantially 45 degrees fluid spray nozzle having a fluid tip orifice and atomizing air bores is shown.
Figure 5B:
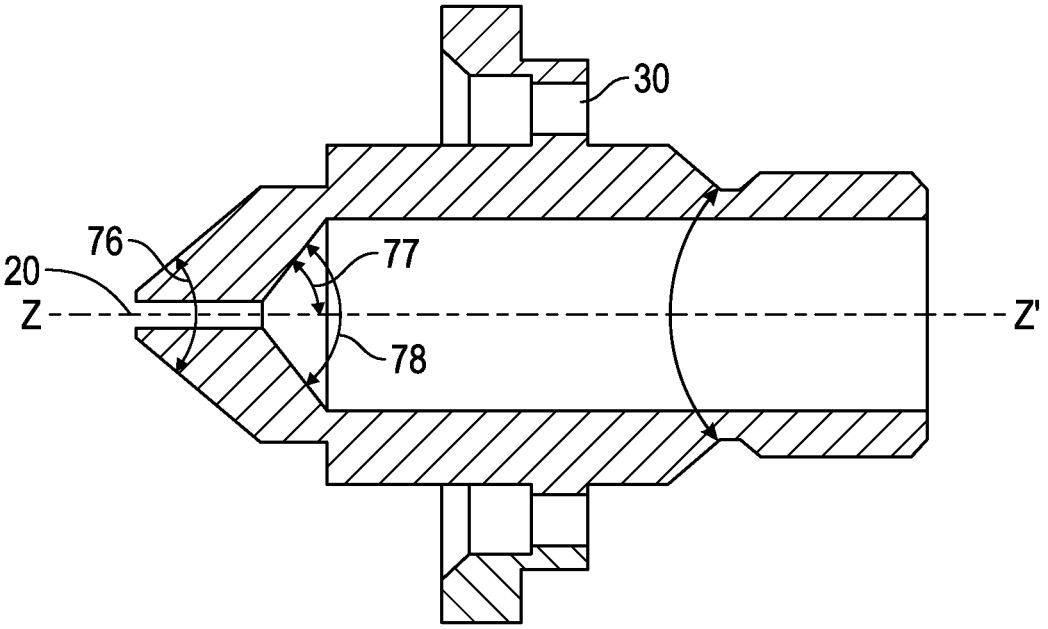

The atomization air flow is directed through an atomizing air passage 83 a space formed by the air cap opening inner-surface 62 of the air cap (FIGS. 4A-4E) and the external nozzle surface 72 of the fluid spray nozzle (FIGS. 5A-5C) at the fluid tip orifice end of the fluid spray nozzle in a properly assembled fluid spray nozzle and air cap assembly. The air cap opening inner-surface 62 can be configured to have an air cap opening inner-surface angle 84 in a range of from substantially 10 to 75 degrees relative to the rotational axis Z-Z'. The air cap opening inner-surface angle 84 can be measured between an air cap opening inner-surface extension C-C' and the rotational axis Z-Z' on a perspective cross-sectional plane of the air cap intersecting the rotational axis Z-Z' and parallel to the rotational axis Z-Z' (FIGS. 4A and 4E). The external nozzle surface 72 is configured to have an external nozzle surface angle 74 (e.g. FIG. 5A) in a range of from substantially 10 to 75 degrees, relative to the rotational axis Z-Z'. The external nozzle surface angle 74 (FIGS. 5A-5B) can be measured between an external nozzle surface extension N-N' and the rotational axis Z-Z' on a perspective cross-section plane of the fluid spray nozzle intersecting the rotational axis Z-Z' and parallel to the rotational axis Z-Z'. The air cap opening inner-surface angle 84 and external nozzle surface angle 74 can be substantially the same, meaning that the difference in the air cap opening inner-surface angle 84 and the external nozzle surface angle 74 is less that sixty-six degrees. This protects the use of an inner-surface angle 84 with a different external nozzle surface angle 74, within the ranges mentioned, e.g., angle 84 is 75 degrees and angle 74 is 10 degrees. The difference is at it maximum 65 degrees which is lower than 66 degrees. The difference in the air cap opening inner-surface angle 84 and external nozzle surface angle 74 can be in a range of from substantially 0 to 65 degrees in one example, substantially 0 to 15 degrees in another example, substantially 0 to 10 degrees in yet another example, substantially 0 to 5 degrees in yet another example, and substantially 0 to 2 degrees in a further example.

Figure 5C:
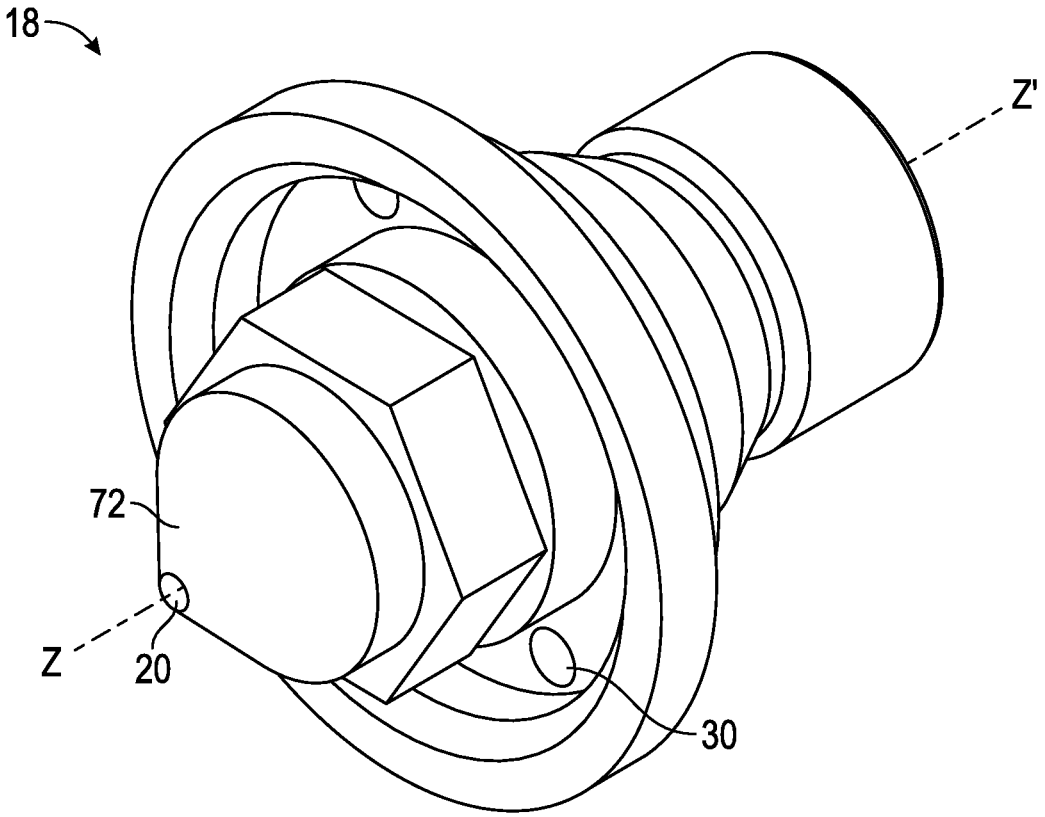

The fluid spray nozzle 18 can have a total external nozzle surface angle 76 (e.g. FIG. 5B) that is an angle defined by the external nozzle surface 72 (FIG. 5C). The external nozzle surface 72 can be configured to be cone shaped. The fluid spray nozzle can further configured to have an inner-nozzle surface having an inner-nozzle surface angle 76 measured from the inner-nozzle surface relative to the rotational axis Z-Z'. A total inner-nozzle surface angle 78 (FIG. 5B) is an angle defined by the inner-nozzle surface. The fluid spray nozzle 18 can comprise one or more atomization air distribution channels 30 (e.g., FIG. 3A).

Figure 7A:
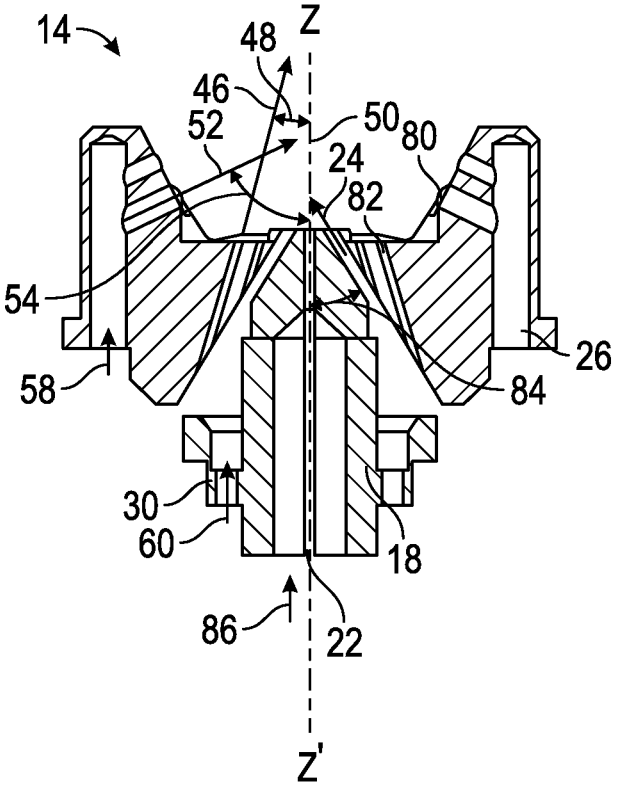
FIGS. 7A-7C show representative examples of schematic presentations of directions of the coating composition jet, atomization air flow, and fan air flow with (A) a cross-sectional view of the air cap and fluid spray nozzle assembly having a hollow needle, (B) a detailed view of the orifice and air cap spray opening, and (C) a schematic representation of the rotational symmetry and the atomization air flow angle between the atomization air flow and the rotational axis Z-Z'. These figures also show a schematic presentation of a direction of the atomization air flow into the coating composition jet of substantially 45 degrees and of a direction of the atomization air flow into the coating composition jet of substantially 30 degrees.

The air cap 14 can further comprise two or more fan air horns 28 (e.g., FIGS. 4A-4B), each comprising one or more fan air outlets 80. When in operation and supplied with the fan air 58 through the fan air distribution channel 26, the fan air outlets can be configured to deliver fan air jets 52 at a fan air jet angle 54 in a range of from 15 to 89 degrees relative to the rotational axis Z-Z' (e.g., FIG. 7A). The air cap can further comprise one or more supporting air channels 82 (e.g., FIG. 3). The fan air jets are used for shaping fan pattern of the coating composition jet 14. A fraction of the atomizing air 60 can be configured to jet through the supporting air channels 82 to form supporting air jets 46. The supporting air jets can be a fraction of the atomizing air, such as in a range of from substantially 0.01% to 99% in one example, substantially 0.01% to 50% in another example, substantially 0.01% to 20% in another example, and substantially 0.01% to 10% in yet another example, and 0.01% to 5% in yet another example, the percentage based on the air volumes of the supporting air jet and the atomizing air. The supporting air jets can help to keep the air cap clean and also provide air jets for shaping the fan shape of the coating composition jet 50.

Figure 2A:
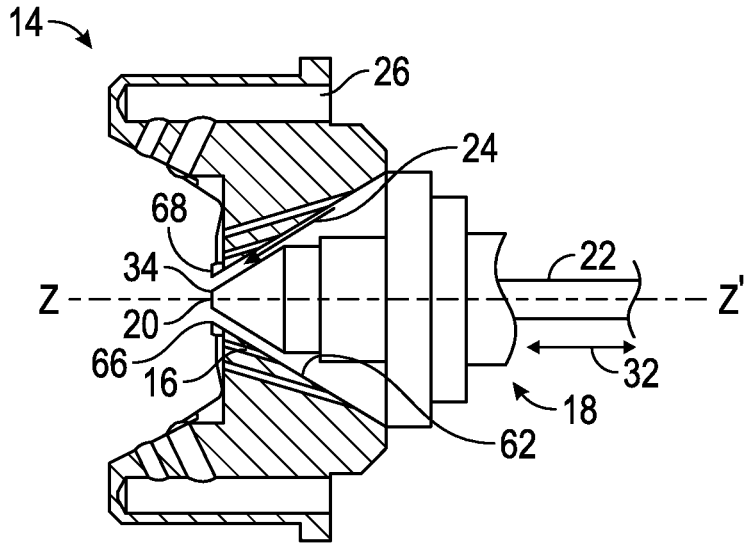
FIGS. 2A and 2B are representative cross-sectional views of the air cap and fluid spray nozzle assembly and one example of a fluid spray nozzle/air cap/hollow needle assembly in accordance with an embodiment that can be used having separate atomizing air distribution channels that provide atomizing airflow to the air cap openings and fan air distribution channel, providing fan airflow to air cap horn openings.
Figure 2B:
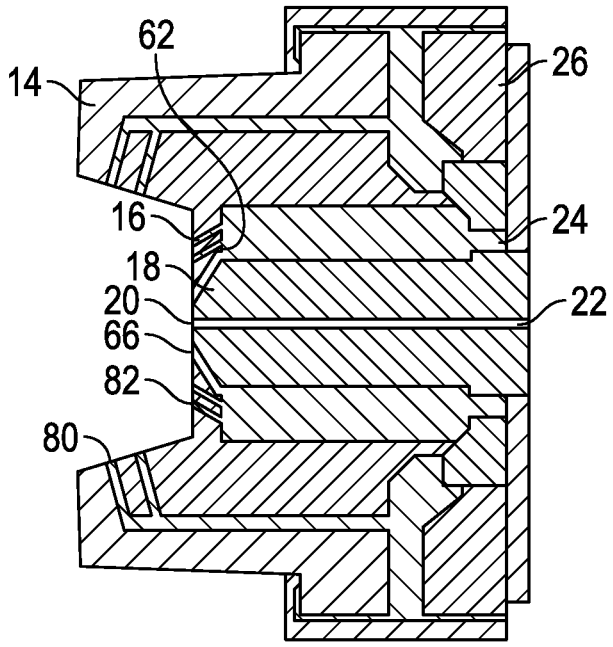
Figure 3A:
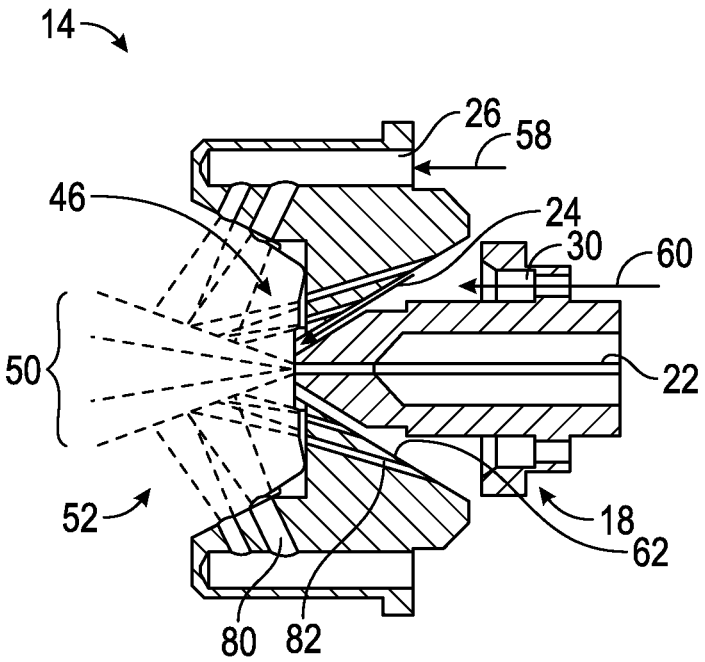
FIGS. 3A and 3B are representative cross-sectional views of the air cap and fluid spray nozzle assembly in a spraying configuration with the spray hollow needles at an open position.
Figure 3B:
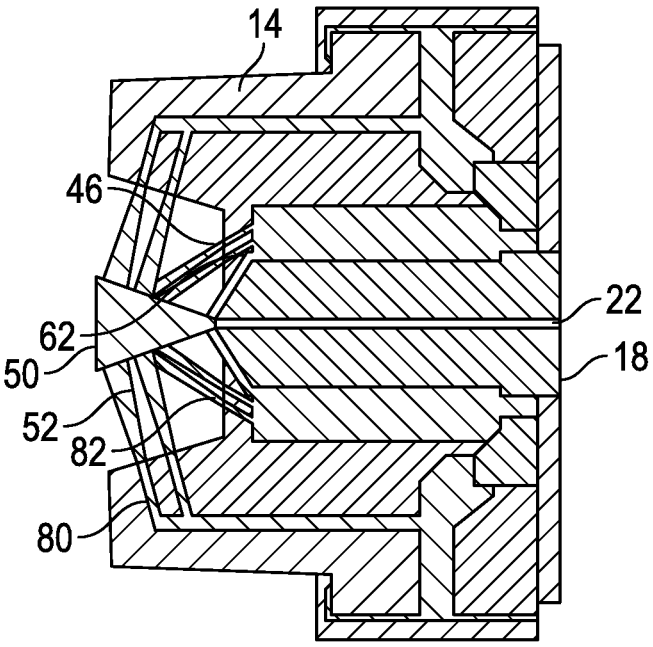

The fluid spray nozzle and air cap assembly is free from any structure disrupting or changing the atomization air flow 24 at the atomization air flow angle 84 (e.g., FIGS. 4A to 4C) around the fluid tip orifice 20 and the air cap spray opening 66 (e.g., FIGS. 2A and 2B). The fluid spray nozzle and air cap assembly is configured to direct the atomization air flow 24 at the atomization air flow angle 84. The fluid tip orifice can be configured to be at the immediate cone tip end of the fluid spray nozzle defined by a cone shaped external nozzle surface 72 with the outmost plane of the fluid tip orifice 34 intersecting directly with the external nozzle surface 72. The air cap opening inner-surface 62 can directly intersect the external plane 68 of the air cap spray opening 66. The fluid tip orifice can be configured to be at the immediate cone tip end of the fluid spray nozzle defined by a cone shaped external nozzle surface 72 (FIG. 5A) with the outmost tip plane of the fluid tip orifice 34 intersecting directly with the external nozzle surface 72, and the air cap opening inner-surface 62 is directly intersects the external plane 68 of the air cap spray opening 66.

Figure 6A:
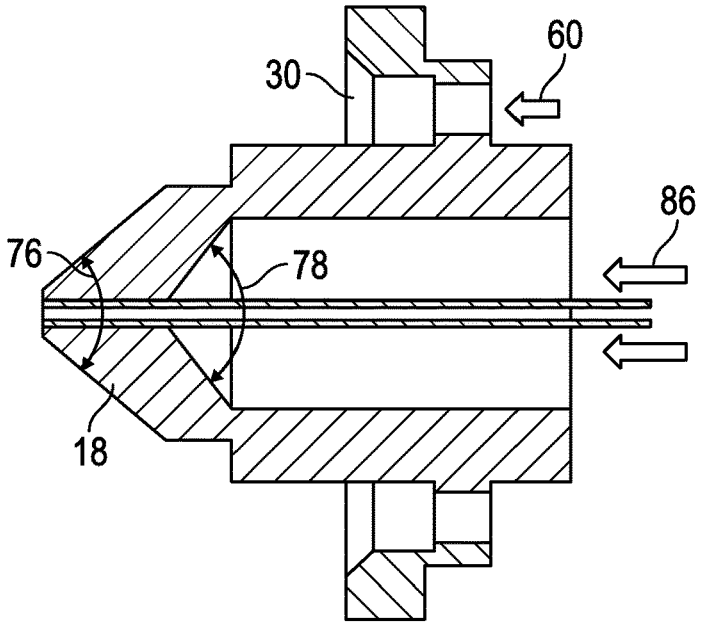
FIGS. 6A-6D illustrate representative cross-sectional views of an example of the fluid spray nozzle in a non-spraying configuration with the hollow spray needle in a closed position and an example of a fluid spray nozzle having a tip rim. These Figures also show one embodiment of a fluid spray nozzle having a needle and bores for the atomizing air. In a further embodiment, an angle paint jet/atomizing air flow of substantially 45 degrees is used.
Figure 6B:
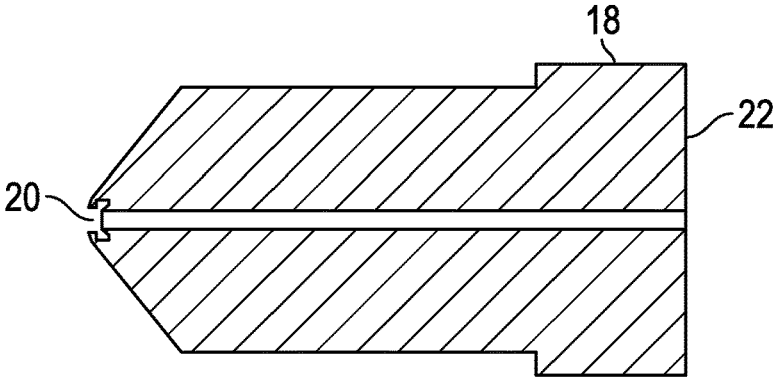
Figure 6C:
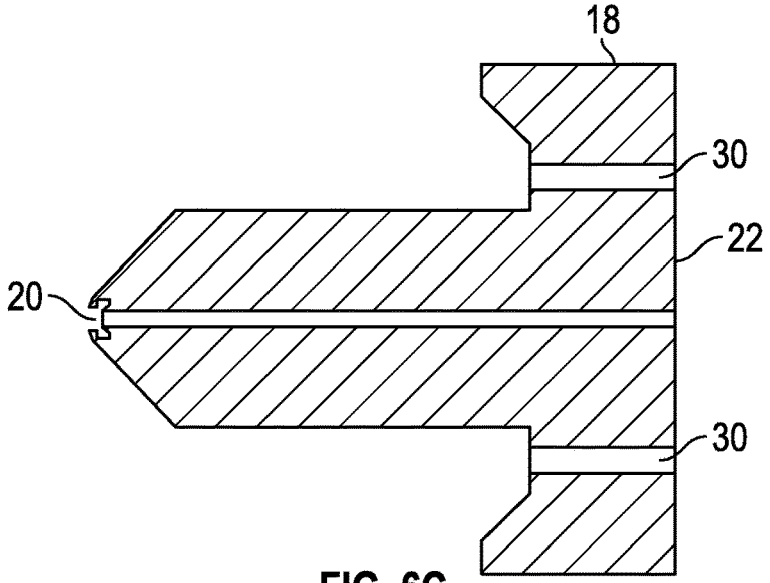
Figure 6D:
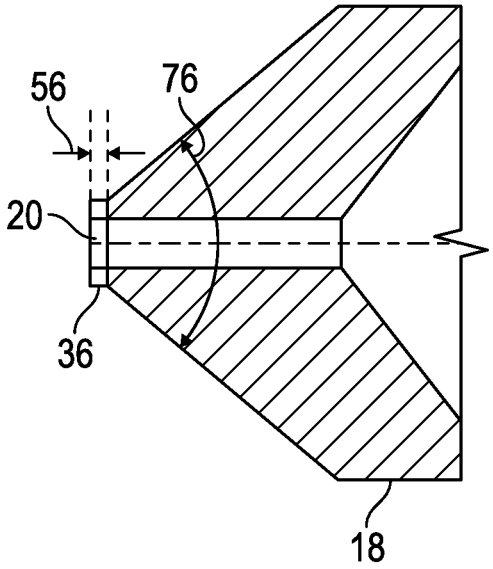

FIG. 6 shows representative examples of details of the spray gun with the hollow spray needle at a closed position within the fluid spray nozzle (FIGS. 6A-6C). At the closed position, the coating 86 can be supplied to the fluid spray nozzle. However, no coating is sprayed out of the fluid tip orifice. The atomizing air 60 can be supplied independent from the coating 86. The fluid spray nozzle can have a tip rim 36 (FIG. 6D). The tip rim can have a tip rim height 56, the distance between the outmost plane of the fluid tip orifice 34 and the intersection point with the external nozzle surface 72, is in a range of from substantially 0 to 1.0 mm in one example, substantially 0 to 0.8 mm in another example, substantially 0 to 0.6 mm in yet another example, substantially 0 to 0.4 mm in yet another example, substantially 0 to 0.2 mm in yet another example, and substantially 0 to 0.1 mm in a further example.

The air cap can have an air cap rim 70 immediately around the air cap opening 66 (FIGS. 4D-4E) with an air cap rim height 64 measured from the external plane 68 of the air cap spray opening 66 to the air cap external surface 16. The air cap rim height 64 may be in a range of from substantially 0 to 1.0 mm in one example, substantially 0 to 0.8 mm in another example, substantially 0 to 0.4 mm in yet another example, substantially 0 to 0.2 mm in yet another example, and substantially 0 to 0.1 mm in a further example.

Figure 7B:
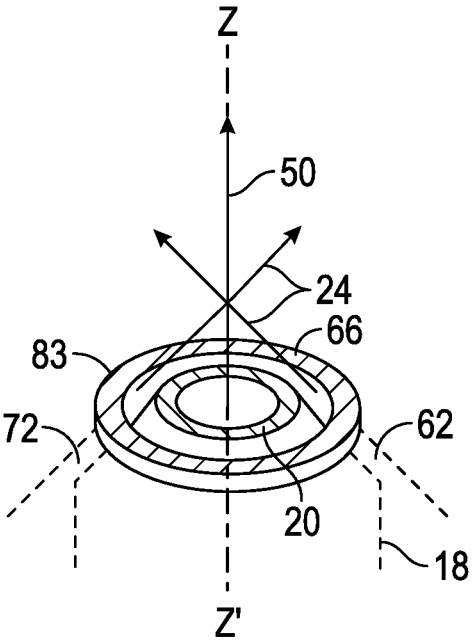

FIG. 7 shows schematic presentations of the spray gun in a spraying configuration with the hollow spray needle 22 in an open position allowing the coating 86 to spray out of the fluid tip orifice 20 to form the pre-atomized coating composition jet 50 along the direction of the rotational axis Z-Z'. The atomizing air 60 is supplied through the atomization air distribution channels 30 forming the atomization air flow 24 flowing through the atomizing air passage 83 and jetting out of the air cap spray opening 66 at the atomization air flow angle 84. The liquid coating composition jet is further atomized by the atomization air flow 24 after exiting the fluid tip orifice 20. The fan air 58 is supplied through the fan air distribution channels 26 and jets out of the fan air outlets 80 forming the fan air jets 52 at the fan air jet angle 54 relative to the rotational axis Z-Z'. The supporting air jets 46 can be jetted out of the supporting air channels 82 at a supporting air jet angle 48 relative to the rotational axis Z-Z'. The supporting air jet angle 48 can be in a range of from 10 to 75 degree. The supporting atomization air jets 82 can give additional atomization and can prevent the atomized coating returning back to the air cap surface. The atomization air flow 24 can form a continuous cone shaped air flow around the fluid tip orifice 20 through the atomizing air passage 82 (FIG. 7B). The atomizing air flow 24 can impact the pre atomized coating composition jet 50 causing the coating to atomize further into smaller droplets.

Figure 7C:
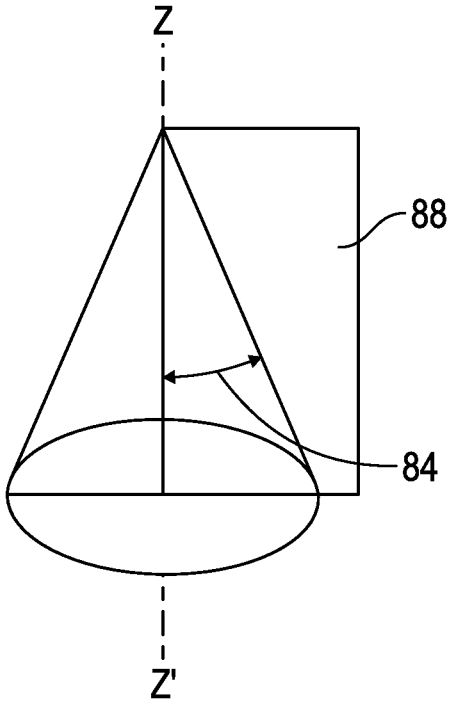

The atomization air flow angle 84 can be measured between the projected atomization air flow 24 and the rotational axis Z-Z' of the fluid spray nozzle on a perspective cross-section plane 88 intersecting the rotational axis Z-Z' and parallel to the rotational axis Z-Z' (FIG. 7C). The atomization air flow angle 84 can be in a range of from substantially 10 to 75 degrees in one example, substantially 10 to 20 degree in another example, substantially 20-30 degree in yet another example, substantially 30 to 40 degree in yet another example, substantially 40 to 50 degree in yet another example, substantially 50 to 60 in yet another example, and substantially 60 to 75 degree in a further example. In a further example, the air cap and spray fluid nozzle assembly can have an external nozzle surface angles 74 at about 60 degrees. In an even further example, the air cap and spray fluid nozzle assembly can have an external nozzle surface angle 74 of about 45 degrees. In yet a further example, the air cap and spray fluid nozzle assembly can have an external nozzle surface angle 74 of about 30 degrees. The substrate can be coated with coating layers sprayed using the same or different spray guns. The substrate can be spray coated in horizontal or vertical positions. The spray gun of can be used to produce any coating layers on a substrate, such as a primer coating layer, a basecoat coating layer, a topcoat coating layer, a clearcoat coating layer, or a combination thereof. The spray gun can also be used to produce one or more additional coating layers on a substrate already coated with one or more coating layers. In one example, an article can be coated with one or more basecoat layers with any conventional spray gun and subsequently coated with one or more clearcoat coating layers with the spray gun in accordance with the embodiments descried herein. In another example, an article can be coated with one or more basecoat coating layers and one or more clearcoat coating layers with the spray gun in accordance with the embodiments described herein.

Coating compositions suitable for using the spray gun in accordance with the embodiments described herein can be any coating compositions that are suitable for spraying with a spray gun. The coating composition can be a solvent borne coating composition that comprises from substantially 10% to 90% of one or more organic solvents, or a waterborne coating composition that comprises from substantially 20% to 80% of water based on the total weight of the coating composition.

The coating composition can be a "two-pack coating composition", also known as a 2K coating composition, with two components of the coating composition stored in separate containers and sealed to increase the shelf life of the components of the coating composition during storage. The coating composition can be a "one-pack coating composition", also known as a 1K coating composition, such as a radiation curable coating composition or a coating composition contains cross linkable components and blocked crosslinking components such as blocked isocyanates that can be deblocked under certain deblocking conditions.

The coating composition can be a mono-cure or a dual cure coating composition. A mono-cure coating composition can be cured by one curing mechanism. In one example, a mono-cure coating composition can contain one or more components having acrylic double bonds that can be cured by UV radiation in which the double bonds of the acrylic groups undergo polymerization to form a cross-linked network. In another example, a mono-cure coating composition can be cured by chemical crosslink and contain crosslinking groups and cross linkable groups that can react to form a cross-linked network. A dual-cure coating composition is a coating composition that can be cured by two curing mechanisms, such as UV radiation and chemical crosslink.

Figure 8A:
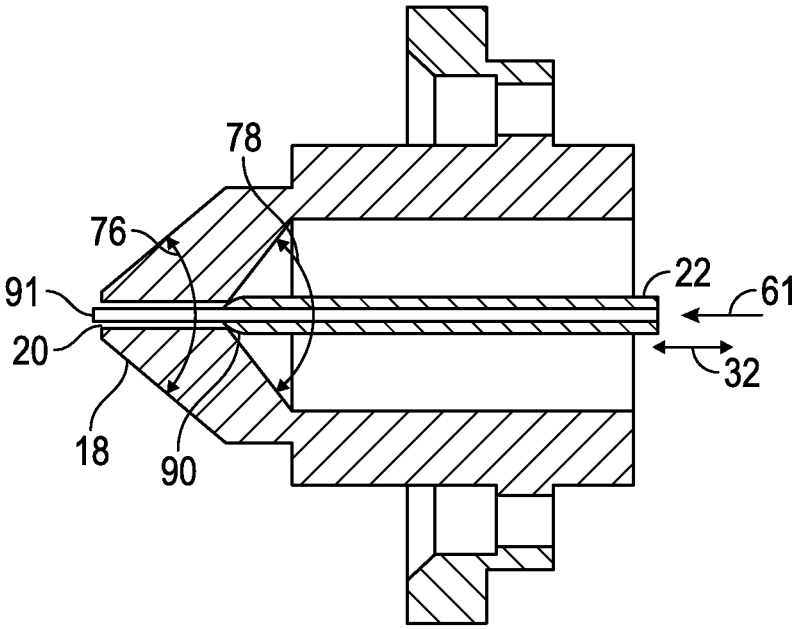
FIGS. 8A and 8B are cross-sectional views of a hollow needle wherein the hollow needle is respectfully in the closed position and the open position.
Figure 8B:
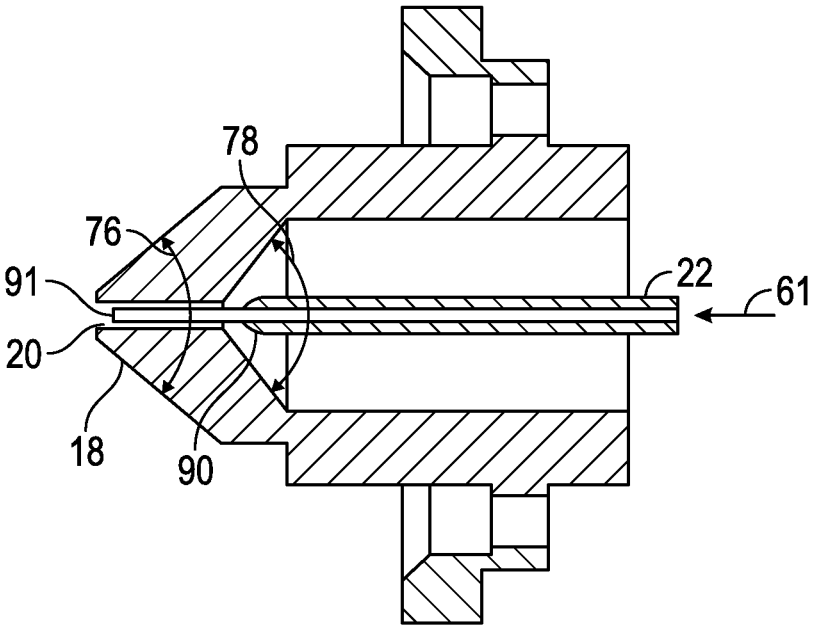
Figure 8C:
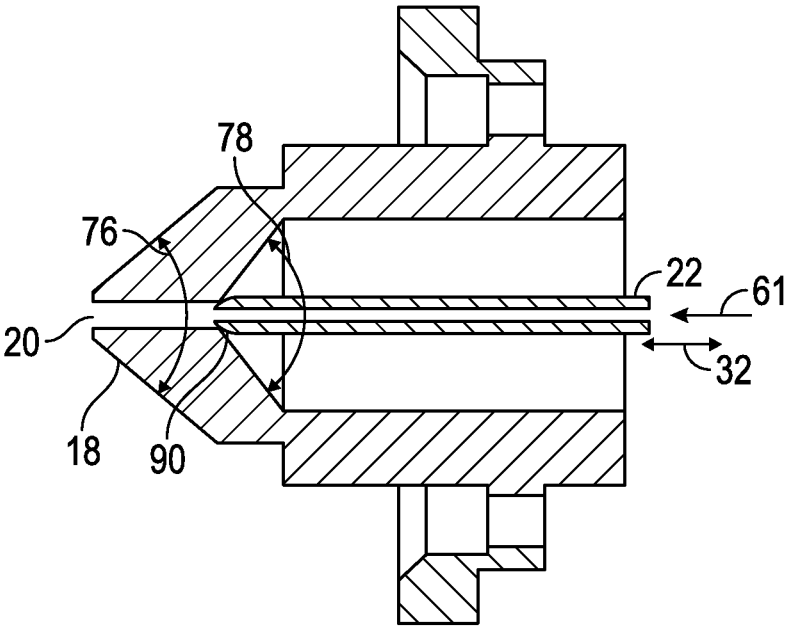
FIGS. 8C and 8D are cross-sectional views of a hollow needle without extension in the closed position and the open position, respectively, in accordance with an exemplary embodiment.
Figure 8D:
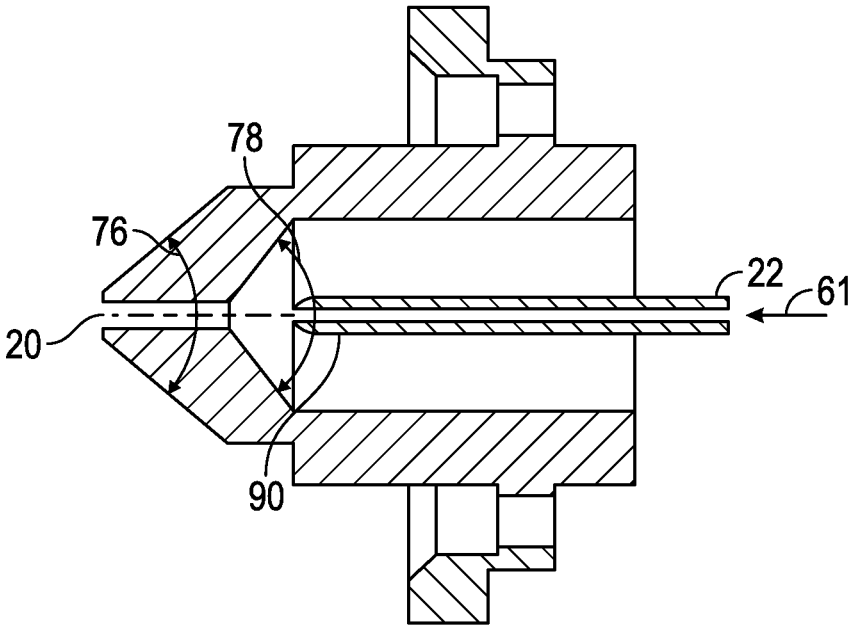
Figure 8E:
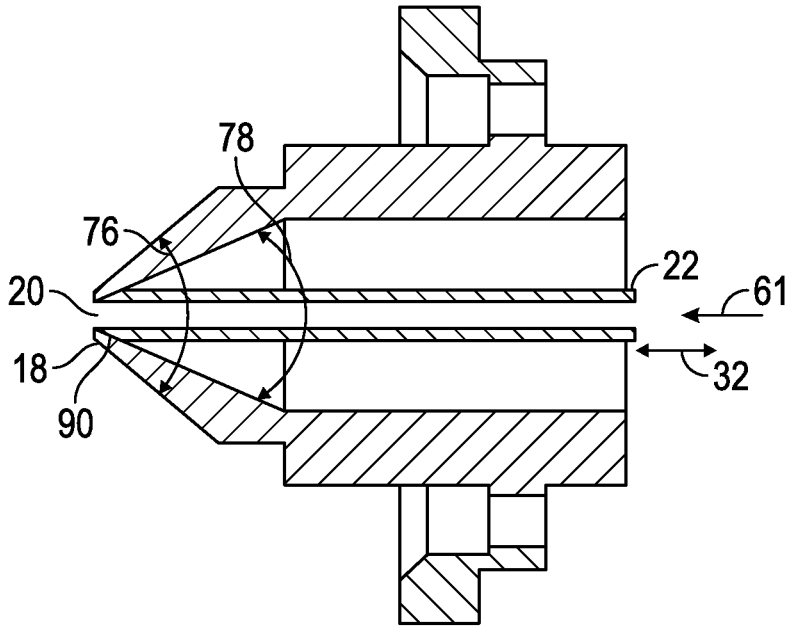
FIGS. 8E and 8F are cross-sectional views of a single stage hollow needle without extension in the closed position and the open positions, respectively, in accordance with a further exemplary embodiment.
Figure 8F:
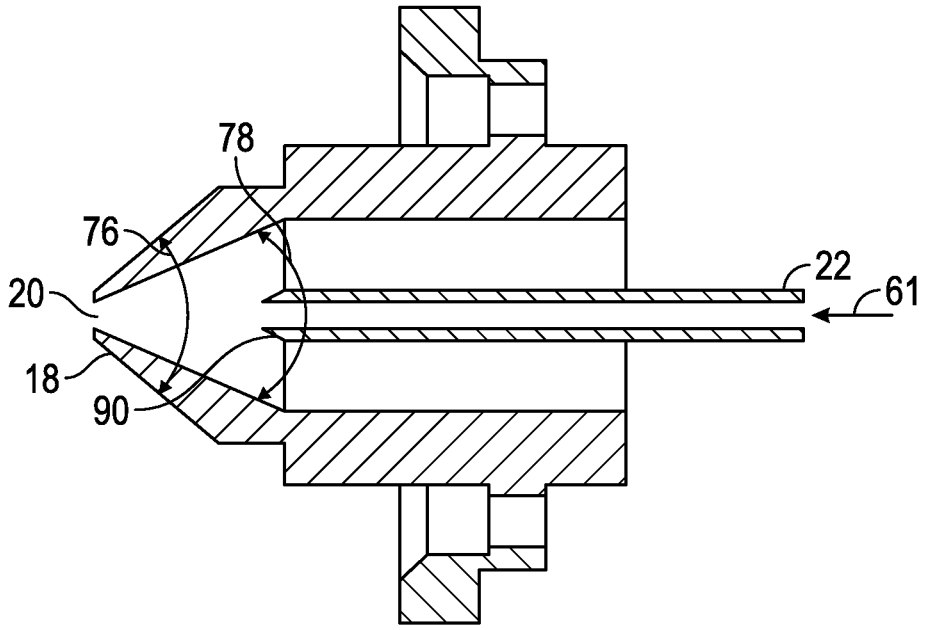
Figure 8G:
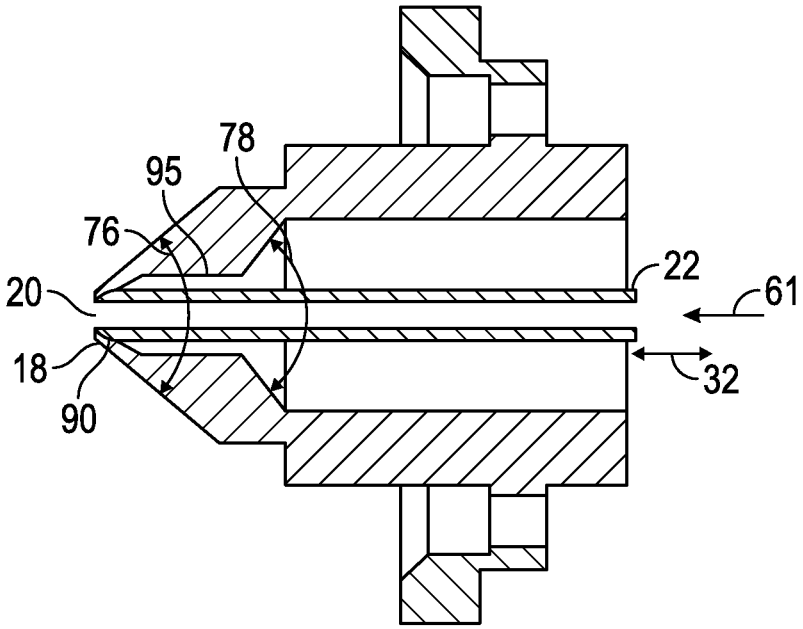
FIGS. 8G and 8H are cross-sectional views of a two-stage nozzle in accordance with a further exemplary embodiment.
Figure 8H:
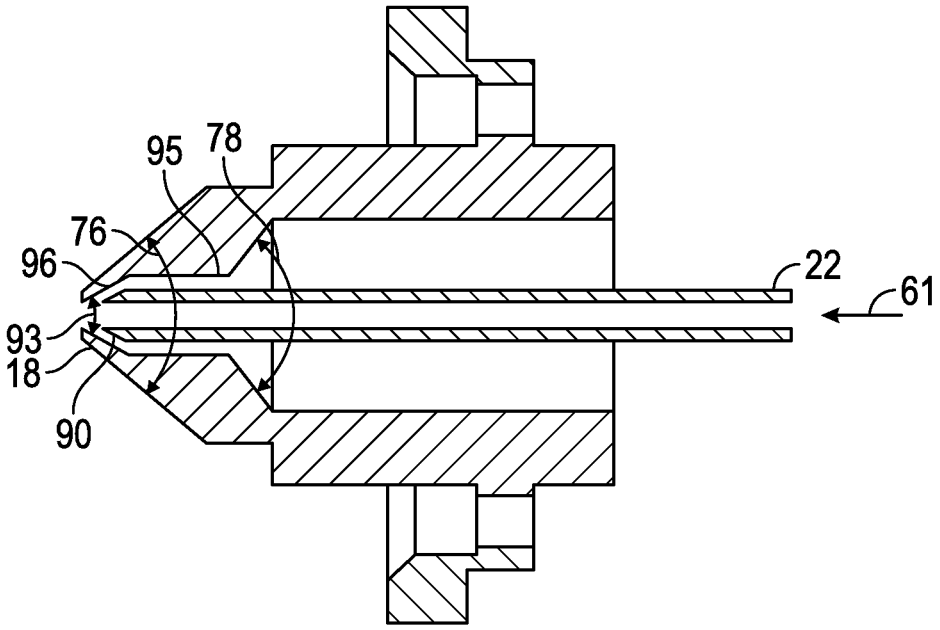

Examples of a hollow needle can include those shown in FIGS. 8A and 8B. In FIG. 8A a hollow needle 22 having a needle shoulder seal 90 and extension 91 is shown in a closed position where the needle shoulder seal 90 is seated against and seals the orifice preventing the flow of paint. In FIG. 8B, the hollow needle 22 is in an open position. Needle atomization air 60 can be fed into the hollow needle and comprises a portion or all of the atomizing air 60. The needle atomization air 60 can be fed to the needle in either the closed or the open position. It can be of advantage to feed the needle atomization air to the hollow needle before the needle is in the open position so the orifice can be cleaned and provide a steady atomization air flow. The needle shoulder seal can be configured to match the internal surface of the nozzle to seal the orifice when it is in the closed position.

Figure 8I:
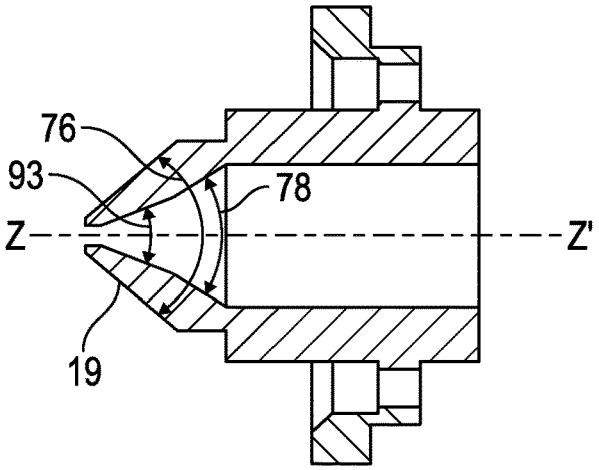
FIGS. 8I, 8J, and 8K are cross-sectional views of a two-stage nozzle in accordance with a further exemplary embodiment.
Figure 8J:
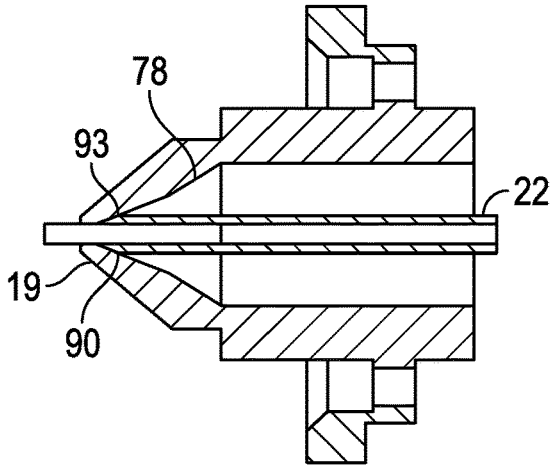

Hollow needle devices may be provided with an extension such as is shown at 91 in FIGS. 8A, 8B, 8J, and 8K. Extensions 91 are also shown in the hollow needles of FIGS. 8J and 8K. Hollow needles may also comprise single stage nozzles (e.g. 18 in FIGS. 8A-8F) or two-stage nozzles (e.g. 19 in FIGS. 8I-8K).

Figure 8K:
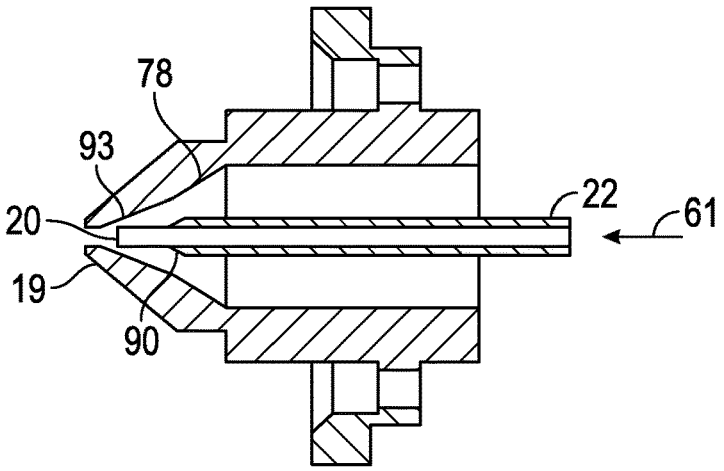

A single stage nozzle is one in which the inner nozzle surface 93 is configured to have an internal surface at one angle; i.e. oriented at a single angle (e.g. 78 in FIGS. 8A-8F). In a two stage nozzle, the nozzle surface is configured to have two angles (e.g. 78 and 93 in FIGS. 8I-8K). Internal angle 93 is preferably less that internal angle 78 with respect to longitudinal axis Z-Z' in FIG. 8I. Thus, the nozzle internal surface is configured to have two internal circumferential surfaces that intersect each other as is shown in FIGS. 8L-8K. Alternatively, the two angular internal circumferential surfaces may be separated by a spacing surface 95 that is essentially parallel and rotationally symmetric to axis Z-Z'. The projected angle between the spacing surface 95 and the rotational axis Z-Z' can range from about plus or minus 0.01 degree to about ten degrees between the nozzle internal surface. In one example, the angle 93 can range from about 0.1 to about sixty degrees; i.e. about 0.05 to about thirty degrees between the nozzle internal surface 96 and the rotational axis Z-Z' (FIG. 8L). Angle 78 can range from about 0.1 to about sixty degrees greater that of angle 93.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the present disclosure as set forth in the appended claims and their legal equivalents.

The invention claimed is:

1. A paint spray gun comprising:

a spray gun body;

an air cap;

a fluid spray nozzle having a fluid tip;

a hollow needle capable of assuming at least an open position allowing paint to spray out of the fluid tip and a closed position;

a paint cup affixed to the spray gun body;

at least one air distribution channel for atomizing air; and at least one air distribution channel for fan air;

wherein the hollow needle is connected to an atomization air duct, wherein the hollow needle is configured to transport atomizing air through the hollow needle into the fluid spray nozzle to generate an area of low pressure in front of the fluid tip such that a gravity feed from the paint cup is possible; and wherein the fluid spray nozzle and air cap are configured to direct a portion of the atomizing air to form an atomization air flow in a rotational symmetry around a rotational axis Z-Z' of the fluid spray nozzle at an atomization air flow angle in a range of from 10 to 75 degrees, relative to the rotational axis Z-Z', wherein the atomization air flow directed in the rotational symmetry around the rotational axis Z-Z' generates an area of positive pressure in front of the fluid tip preventing gravity feed from the paint cup, absent the atomizing air transported through the hollow needle.

2. The spray gun of claim 1 further comprising an extension in the hollow needle.

3. The spray gun of claim 1 wherein the hollow needle comprises a shoulder seal that seats against a nozzle orifice in the closed position.

4. A paint spray gun comprising:

a spray gun body;

an air cap;

a fluid spray single stage nozzle including a first internal surface at a first predetermined angle with respect to a rotational axis Z-Z' of the fluid spray single stage nozzle;

a hollow needle capable of assuming at least an open position and a closed position, wherein the hollow needle is connected to an atomization air duct, wherein the hollow needle is configured to transport atomizing air through the hollow needle into the fluid spray nozzle to generate an area of low pressure in front of the fluid tip such that a gravity feed of a paint supply is possible;

at least one air distribution channel for atomizing air; and at least one air distribution channel for fan air; and wherein the fluid spray single stage nozzle and air cap are configured to direct a portion of the atomizing air to form an atomization air flow in a rotational symmetry around the rotational axis Z-Z' of the fluid spray single stage nozzle at an atomization air flow angle in a range of from 10 to 75 degrees, relative to the rotational axis Z-Z', wherein the atomization air flow directed in the rotational symmetry around the rotational axis Z-Z' generates an area of positive pressure in front of the fluid tip preventing gravity feed the paint supply, absent the atomizing air transported through the hollow needle, and wherein the combination of atomizing air from the hollow needle and the atomizing air flow in the rotational symmetry around the rotational axis Z-Z' results in a low pressure in front of the fluid tip such that gravity feed of the paint supply is possible.

* * * * *